US005198235A

United States Patent [19]

Reichstein et al.

[11] Patent Number: 5,198,235

[45] Date of Patent: Mar. 30, 1993

[54] APPARATUS FOR VERTICAL SLIPFORMING OF CONCRETE WALLS

[76] Inventors: Stuart W. M. Reichstein; Gerals R. Goldgraben, both of 14808 Keeneland Cir., North Potomac, Md. 20878

[21] Appl. No.: 790,069

[22] Filed: Nov. 12, 1991

Related U.S. Application Data

[63] Continuation-in-part of Ser. No. 674,143, Mar. 25, 1991, abandoned.

[51] Int. Cl.[5] ..... E04G 11/22

[52] U.S. Cl. ..... 425/62; 249/20; 249/22; 249/115; 264/33; 425/63; 425/64; 425/135; 425/150

[58] Field of Search ..... 249/20-22, 249/112, 114.1, 115; 425/62-65, 150, 169, 135; 264/33

[56] References Cited

U.S. PATENT DOCUMENTS

| | | | |
|---|---|---|---|
| 1,562,465 | 11/1925 | Nelson | 249/47 |
| 1,730,727 | 10/1929 | Gurley | 425/150 |
| 2,530,102 | 11/1950 | Von Bampus | 249/27 |
| 2,745,166 | 5/1956 | Fogg et al. | 249/27 |
| 2,851,759 | 9/1958 | Berntsen | 425/150 |
| 2,885,762 | 5/1959 | Johansson | 249/20 |
| 3,252,199 | 5/1966 | Bossner | 425/65 |
| 3,363,873 | 1/1968 | Barber et al. | 425/62 |
| 3,425,659 | 2/1969 | Eriksson | 249/18 |
| 3,453,707 | 7/1969 | Johansson | 249/20 |
| 3,497,579 | 2/1970 | Barron | 249/20 |
| 3,510,098 | 5/1970 | Fox | 249/20 |
| 3,516,129 | 6/1970 | Yoder | 425/150 |
| 3,618,181 | 11/1971 | Veale | 249/20 |
| 3,659,977 | 5/1972 | Haws | 425/62 |
| 3,659,978 | 5/1972 | Svensson et al. | 249/20 |
| 3.938,776 | 2/1976 | Frazier | 249/114.1 |
| 3,973,885 | 8/1976 | Schmidt | 425/65 |
| 4,014,633 | 3/1977 | Goughnour | 425/135 |
| 4,076,778 | 2/1978 | Whitting | 249/22 |
| 4,253,810 | 3/1981 | Bezhanov et al. | 425/64 |
| 4,374,634 | 2/1983 | Ahl | 425/65 |
| 4,761,126 | 8/1988 | del Valle | 425/62 |
| 5,021,202 | 6/1991 | Novotny | 425/62 |

FOREIGN PATENT DOCUMENTS

| | | | |
|---|---|---|---|
| 2052889 | 5/1972 | Fed. Rep. of Germany | 425/62 |
| 118413 | 2/1958 | U.S.S.R. | 425/62 |

*Primary Examiner*—Jay H. Woo
*Assistant Examiner*—James P. Mackey
*Attorney, Agent, or Firm*—Laubscher and Laubscher

[57] ABSTRACT

A device for vertical slipforming of concrete walls includes a rigid frame and at least one slipform assembly suspended from and vertically displaceable with respect to the frame. Concrete is delivered to the interior of each slipform assembly which is incrementally raised as the concrete sets and further concrete is supplied. Thus, concrete panels having a vertical orientation are progressively cast in the slipform assemblies at a job site.

7 Claims, 4 Drawing Sheets

APPARATUS FOR VERTICAL SLIPFORMING OF CONCRETE WALLS

This application is a continuation-in-part of application Ser. No. 07/674,143 filed Mar. 25, 1991, now abandoned.

BACKGROUND OF THE INVENTION

Commercial and residential construction continues to be an important part of any country's economy. However, there are rising concerns about the environment which can have chilling effects on industrial growth. The main concern that could affect the construction industry is the increasing loss of forest resources. Increased demand for construction materials and space for development has resulted in the leveling of large forest areas throughout the world. Expanded use of such materials as concrete may mitigate this problem.

The construction industry has been moving toward the use of mass production techniques. Among these techniques are prefabricated walls, manufactured offsite and transported to the construction site for assembly and the manufacture of modular units, that is, the building of entire rooms or room assemblies in a factory environment, which are then transported to the building site and assembled. Walls represent one of the largest single cost elements of many construction projects. The use of less costly prefabricated walls is replacing more expensive, manual building of walls in place. The prefabricated walls are generally built in a factory and transported over the road to the construction site, but are sometimes fabricated at the site using equipment which can be moved from one project to another. Large numbers of prefabricated concrete walls are normally poured in a horizontal position. Once hardened, the walls are lifted or tilted to a vertical position. The disadvantages of horizontal casting include the need for large floor areas, high labor costs, and the need for large reinforcing bars.

BRIEF DESCRIPTION OF THE PRIOR ART

Portable molds for forming concrete walls at the building site are well-known in the patented prior art as evidenced by the Fogg et al U.S. Pat. No. 2,745,166. A primary drawback of these prior devices is that only a single wall may be produced at a time. A further drawback is that the walls are only formed in sections which must be subsequently assembled.

Also known in the art are slip-form apparatus such as that disclosed in the Eriksson U.S. Pat. No. 3,425,659. This apparatus is used for construction of specialized structures such as a tapered concrete pier, rather than for simultaneous construction of a plurality of concrete walls. Moreover, these prior specialized slip-form devices are not mobile but must be specially constructed on-site in the configuration of and at the specific location where the structure is being built.

The present invention was developed in order to overcome these and other drawbacks of the prior art by providing a portable, adaptable, automated vertical, multiple-wall, continuous concrete slipforming system which responds to commercial and residential construction needs around the world.

SUMMARY OF THE INVENTION

Accordingly, it is a primary object of the present invention to provide an apparatus for vertical slipforming of concrete walls including a rigid mobile frame having a plurality of slipform assemblies suspended therefrom by a plurality of vertically arranged hydraulic cylinders. A concrete supply mechanism is connected with the frame to deliver concrete to the interior of the slipform assemblies. Upon controlled actuation of the hydraulic cylinders, the slipform assemblies are incrementally raised as the concrete sets, with additional concrete being supplied in incremental layers to the interior of the slipform assemblies. Thus, concrete panels are progressively cast with a vertical orientation within the slipform assemblies.

Each slipform assembly comprises a pair of normally parallel vertical forms having opposed planar surfaces which preferably include a coating of synthetic plastic material to prevent concrete from adhering to the forms. An adjustment mechanism is connected with each form of a slipform assembly to laterally displace and tilt the forms to vary the spacing between the forms and to minimize friction between the forms and the concrete.

One or more slipform assemblies are connected with a horizontal strongback assembly which in turn is connected with the pistons of the hydraulic cylinders. Therefore, a plurality of slipform assemblies are vertically displaced simultaneously upon activation of the cylinders.

A microprocessor controller is provided to control the operation of the slipform assemblies, the adjustment mechanism, and the concrete supply in order to automate and maximize the efficiency of the slipforming operation.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
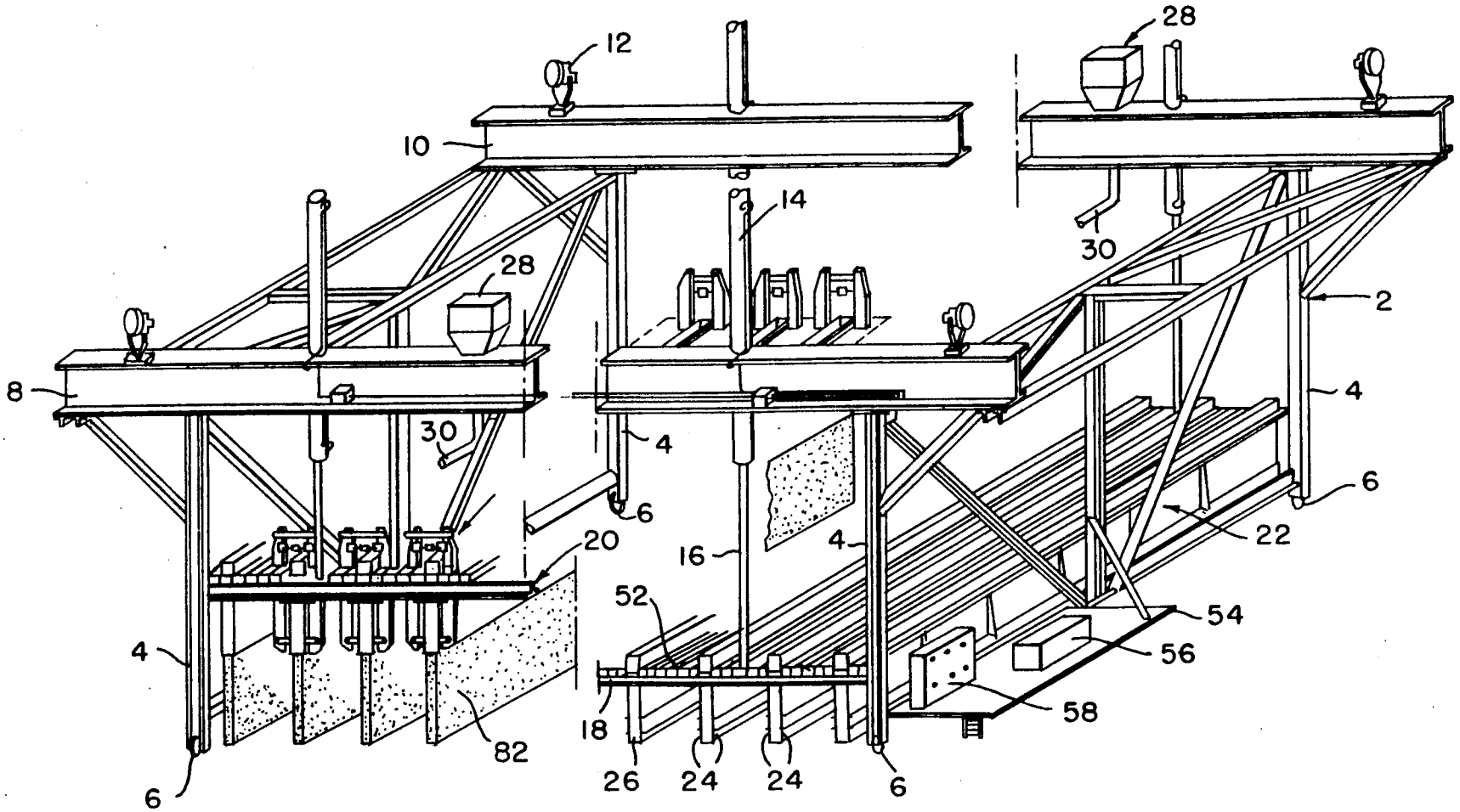
FIG. 1 is a perspective view of the concrete wall vertical slipforming apparatus according to the invention.

Referring first to FIG. 1, the apparatus for vertical slipforming of concrete walls according to the invention includes a rigid frame 2 formed of steel or other suitable material. The frame includes a plurality of legs 4 having wheels 6 at the bottom thereof, whereby the frame may be positioned and moved at a work site. The frame also includes a pair of support beams 8, 10 at the front and rear thereof. Lights 12 are mounted on the support beams to provide illumination during darkness.

Connected with the front and rear support beams are a plurality of vertically oriented hydraulic cylinders 14 each of which has a piston 16 which extends downwardly and retracts upwardly with respect to the associated cylinder as will be developed in greater detail below.

The lower end of each piston is connected with a horizontal strongback or beam. In the example of FIG. 1, the front cylinder to the right of the apparatus has its piston connected with strongback 18 at the front of the apparatus, while the cylinder to the left of the apparatus has its piston connected with a separate strongback 20. Similar strongbacks (not shown) are connected with the pistons of the right and left rear cylinders. It will be appreciated to those skilled in the art that variations of the illustrated arrangement are possible. For example, a greater number of cylinders and strongbacks can be provided. Moreover, while hydraulic cylinders are described and shown, other lifting devices such as jacks, pneumatic cylinders, or electric solenoids may be used as well. Furthermore, single strongbacks may be provided at the front and rear of the apparatus and connected with one or more front and rear cylinders. The arrangement shown affords flexibility in the concrete wall formation process as will be set forth below.

Depending from the front and rear lateral strongbacks are a plurality of vertically oriented slipform assemblies 22. Each assembly includes a pair of normally parallel spaced vertical forms 24 which define elongated cavities in which the concrete panels are formed. End plates 26 are connected between the end edges of the forms to close the ends of the cavities.

Concrete supply chutes 28 are connected with the main support beams 8, 10 of the frame. An elongated flexible tube or hose 30 is connected with each chute to direct the flow of concrete from the chute to the interior of each slipform assembly. Concrete from a concrete truck or mixer is deposited in the chutes using a bucket at the end of a crane. From the chutes, the concrete flows through the hoses to the slipform assemblies.

Figure 3:
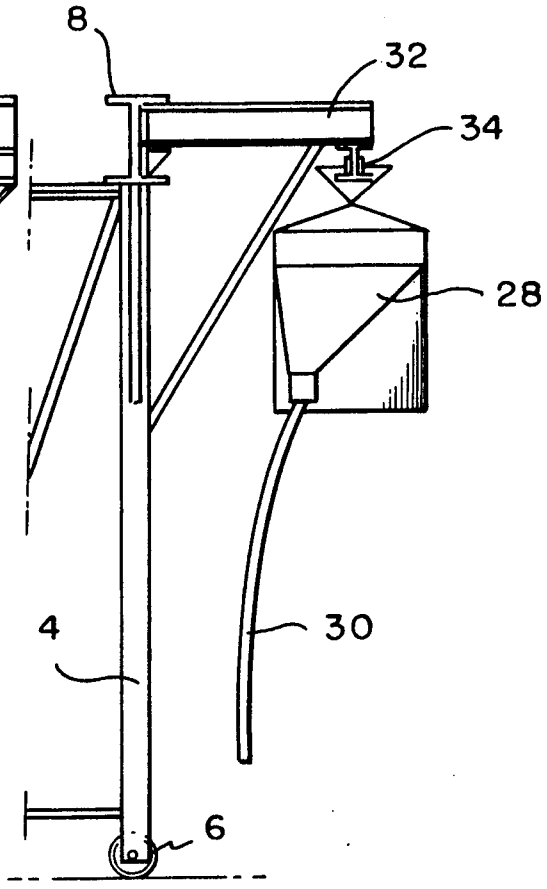
FIG. 2 and 3 are front and side plan views, respectively, of the concrete supply mechanism according to the invention.
Figure 2:
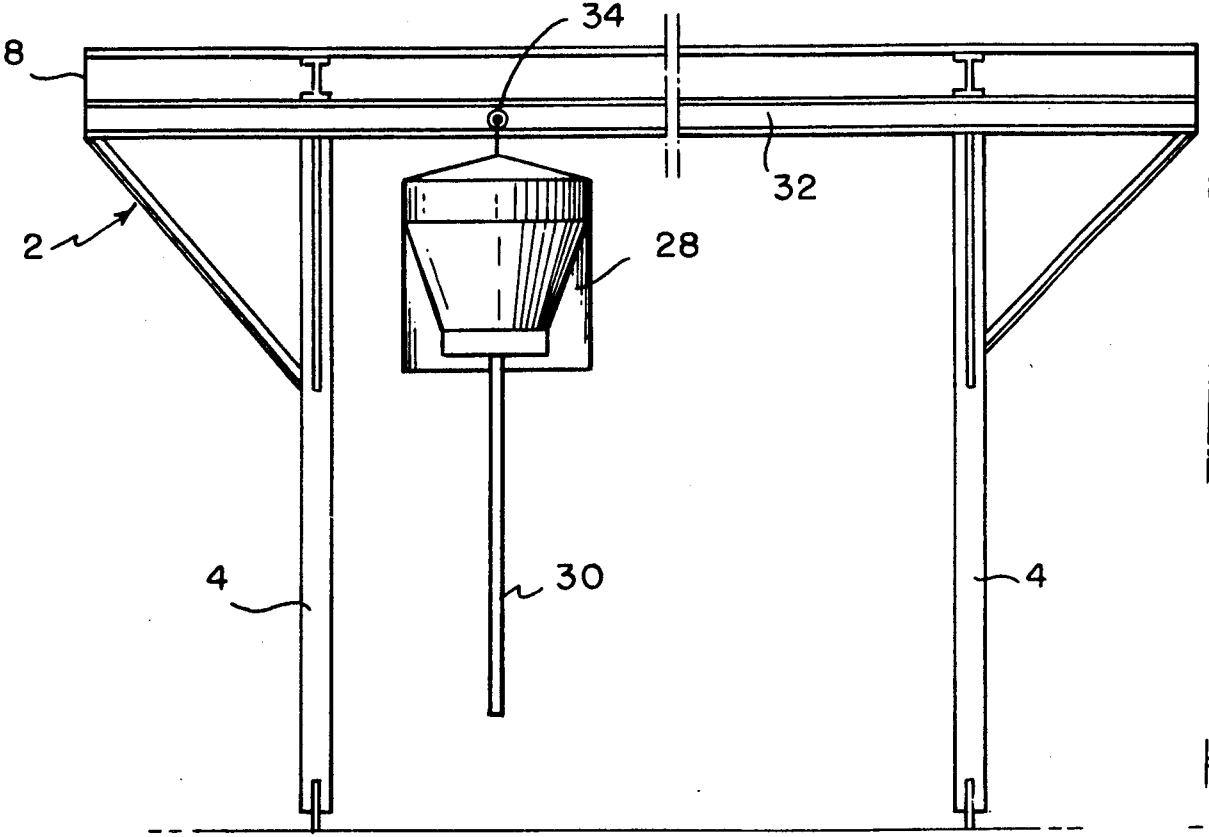

In an alternate arrangement shown in FIGS. 2 and 3, the concrete chutes are displaceable along the length of the beams for positioning adjacent to a slipform assembly being filled with concrete. Other alternatives allow the supply chutes to be lowered to the ground to be filled directly from the concrete trucks. Of course, any number of supply chutes may be provided for filling of the slipform assemblies. Also shown in FIGS. 2 and 3 are rolls of fabric 100, 102 connected with the top and sides, respectively, of the frame. By unrolling the fabric 104, which preferably comprises a thermal insulating material, the frame can be enclosed by side and top walls to define a chamber within which slipforming can proceed in inclement weather. A heater 106 (FIG. 2) is mounted on the frame to supply heat to the interior of the chamber.

Figure 4:
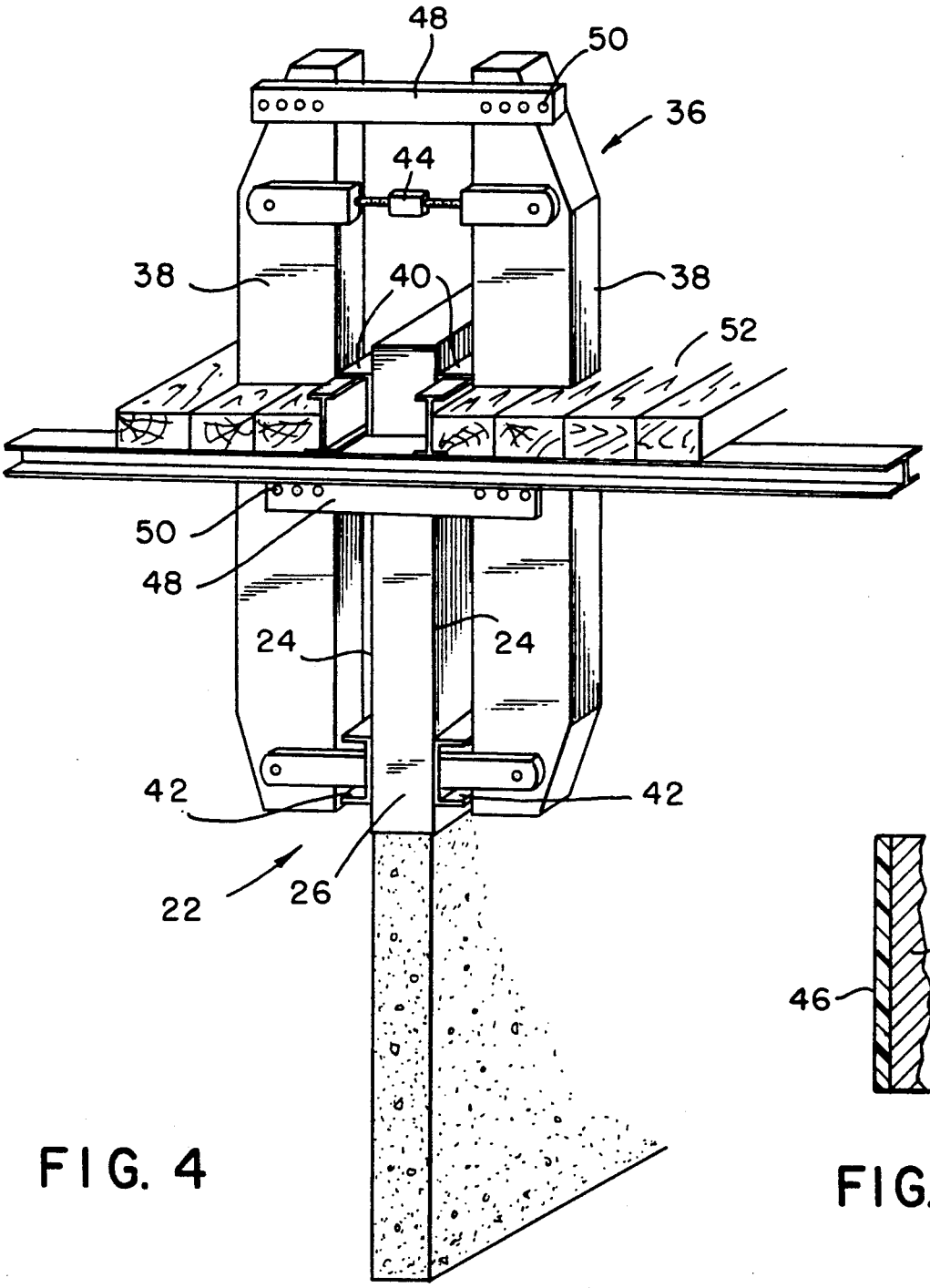
FIG. 4 is a detailed perspective view of the mechanism for adjusting the spacing and tilt of the forms of each slipform assembly.
Figure 5:
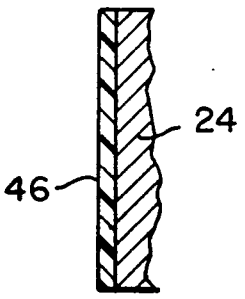
FIG. 5 is a sectional view of a form of the slipform assembly.

Referring now to FIG. 4, one end of a slipform assembly 22 is shown in detail. A form adjustment mechanism 36 is connected with the forms 24 of the slipform assembly. The adjustment mechanism includes a pair of chocks 38 connected with the forms, respectively, via upper brackets 40 and lower brackets 42. A lateral displacement assembly such as a screw mechanism 44 is provided between the chocks and is operable to draft or tilt the chocks, and thus the forms, out of parallel in order to minimize friction between the concrete and the surfaces of each form. Friction between the concrete and the form surfaces is further minimized by coating the form surfaces with a layer of synthetic plastic material 46 as shown in FIG. 5.

The adjustment mechanism 36 can also be used to laterally displace the forms of each slipform assembly to increase or decrease the spacing between the forms, thereby to increase or decrease the thickness of the concrete wall being cast. Adjustment blocks 48 between the chocks include pins which pass through spaced apertures 50 in the blocks to set the spacing between the forms.

Alternate types of adjustment mechanisms may be provided for that shown in FIG. 4. For example, adjustment blocks displaced by solenoids or piston/cylinder assemblies under remote control may be used.

Referring to FIGS. 1 and 4, there are shown work platforms 52 supported on the strongbacks between the slipform assemblies. The work platforms enable a workman to walk along the slipform assemblies and guide the hoses 30 during supply of concrete thereto.

Also shown is an operating platform 54 at one end of the frame 2 on which a hydraulic pump 56 and a control panel 58 are provided to control the operation of the hydraulic cylinders via a microprocessor controller as set forth in greater detail below.

Each hydraulic cylinder preferably has a 15 ton lifting capacity with a 13.5 foot stroke although other size cylinders may be used. The hydraulic lifting system is self-contained and can operate in either a manual or automatic control mode. The lift rate is adjusted through the control panel in accordance with the concrete mix formula. In the manual mode, each cylinder is operated separately.

Figure 6:
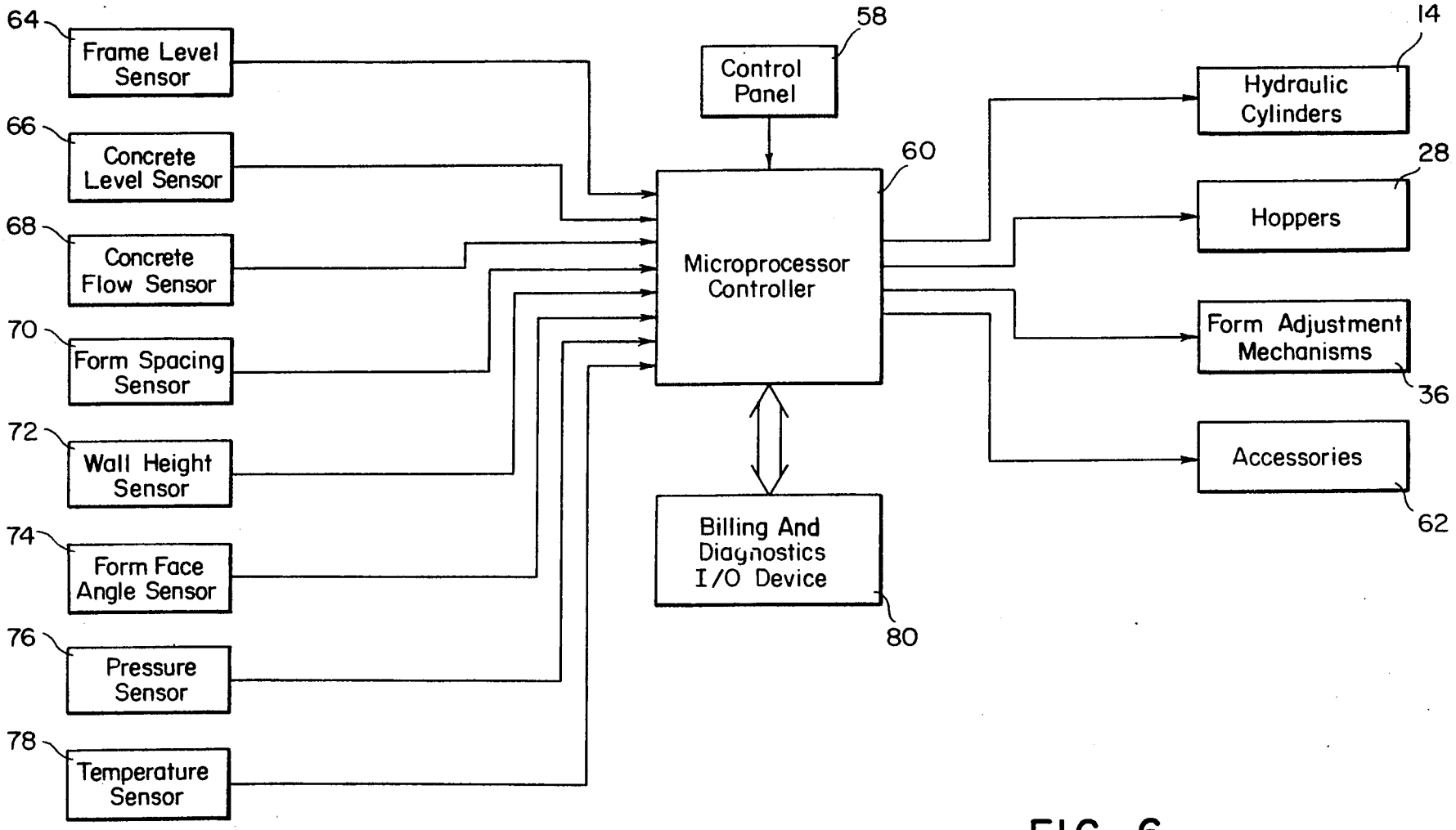
FIG. 6 is a block diagram of the control system for the apparatus of FIG. 1.

The automatic mode of operation will be described with reference to FIG. 6. As shown therein, a microprocessor controller 60 is connected with the hydraulic cylinders 14, the concrete hoppers 28, and the form adjustment mechanisms 36 via control lines. The controller is also connected with various accessories 62 in order to control the lights, movement of the frame, and the like.

The controller 60 — which may be incorporated into the control panel 58 — receives inputs from the operator via the panel 58 and from a plurality of sensors. More particularly the sensors comprise a level sensor 64 mounted on the frame 2, a concrete level sensor 66 for each chamber of the slipform assemblies 22, a concrete flow sensor 68 for each concrete supply hopper 28, a form spacing sensor 70 for each adjustment mechanism 36, a wall height sensor 72 connected with the hydraulic jacks 14, a form face angle sensor 74 connected with each adjustment mechanism 36, a pressure sensor 76 for sensing hydraulic pressure, and a concrete temperature sensor 78. These sensors produce output signals relating to the operating positions of the apparatus and the parameters of the ongoing slipforming operations during continuous and simultaneous casting of a plurality of panels.

The measurements made by the sensors can be used to determine the status of the system, what adjustments to the apparatus need to be made, the need for maintenance, possible reasons for system failure, and system usage. Measurements are sensed and transmitted to the microprocessor on a real time basis.

The microprocessor controller comprises signal processors and generators as well as appropriate algorithms and operational programs configured to control the casting process. The microprocessor continuously receives and processes sensor output signals and generates signals to effect operation of the system apparatus in accordance with the algorithms and programs. For example, the processing of sensor data and the subsequent action of the controllers facilitates the rate of casting, the balancing of hydraulic cylinder movement, the uniformity of the walls being cast and the adjustment of the angle between form surfaces to prevent binding during casting or to break the forms free at the conclusion of the casting cycle.

In addition, the microprocessor processes and stores data for use in billing operations and diagnostics. This information is communicated through a billing and diagnostics I/O device 80. The information may be downloaded at the microprocessor or transmitted via a remote telecommunication link. These outputs facilitate remote or on-site troubleshooting of the apparatus and the compilation of the operating parameters.

OPERATION

Basically, the placing of concrete using slipforms is similar to an extrusion process. Plastic concrete is placed into the forms with the forms acting as moving dies to shape the concrete. The rate of movement of the forms is regulated so that the forms leave the set concrete only after it is strong enough to retain its shape while supporting its own weight.

Reinforcing rods and horizontal ties for each form are prefabricated, lifted by a crane, and placed in each slipform assembly prior to concrete placement. During slipping operations, the reinforcement is supported by guides placed between the yokes of the form. It is extremely important that the lifting points for each wall be determined in advance, and that suitable reinforcements be placed in the wall to support the wall during the lifting operation.

The two stages involved in concrete placement are initial fill and incremental fill. Initially, all forms are filled to a three foot mark. The concrete will remain in the form to set for a predetermined time. After this period, the slipping operation begins. As the slipping operation proceeds, concrete is cast in 4-inch depths in each form. Each vertical form wall is indexed in inches to act as a reference for the depth of cast. For a 12-foot high wall for example, there will be 27 4-inch casts performed in a 6 hour period. In order to facilitate this operation, two 2 cubic yard drop chutes are employed, each with 30 feet of flexible hose and secured on top of a main horizontal supporting beam. Two people can fill ten forms with four inches of concrete in six minutes. This allows ample time between each cast cycle for other activity.

The slipping operation commences after the initial three feet of concrete in each form has set for a predetermined period. All forms are lifted simultaneously by the cylinders via the strongbacks. The cylinders are located at intervals on the strongback to ensure that the reactions on each cylinder are approximately equal. The hydraulic system, controlled by automatically adjusting the flow of oil to each cylinder, maintains constant displacement and horizontal level. The cycle is initiated by the operator starting the hydraulic pump and placing the timer in the continuous mode. In order to ensure breakaway and avoid scoring the concrete surface, the adjustment device is activated. When the required height of the concrete wall 82 is reached, the entire wall is level and has a smooth finish. The lifting operation continues until the bottom of the form clears the wall by approximately one foot.

With ten slipform assemblies per frame, ten straight walls can be cast simultaneously. The surface finishes of the walls can be smooth concrete, simulated wood paneling, brick facing, cut stone, or other textures. Wall sections can be cast with window and door frames, electrical conduits, ductwork, and insulation by pre-erection and setting into the forms. Dovetail end casting for interlocking sections can also be provided.

The concrete walls are set to 40% of compression using high-early within 60–90 minutes. Total set requires sixteen hours. The normal rate of slipping is 2500 square feet/6 hours.

One major feature of the invention is its ability to be moved around on a site. The system can be moved by attaching a portable towbar to each of the two forward vertical columns or legs. The towbars are attached to a truck of adequate capacity and then moved slowly to the new location. The assembly may also be self-propelled. Extreme caution must be exercised when moving the system over curing walls. Depending on the type of concrete used, the type of steel reinforcing in the walls, and the ambient conditions, the walls may be lifted by crane from the casting site. The crane should have a lifting capacity of approximately 8 tons.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. Apparatus for vertical slipforming of concrete walls, comprising (a) a mobile rigid integral frame;

(b) at least one strongback assembly suspended from said frame;

(c) a plurality of slipform assemblies connected with said strongback assembly, each of said slipform assemblies comprising a pair of spaced adjustable vertical forms having opposed planar surfaces defining a cavity;

(d) concrete supply means connected with said frame for delivering concrete to said cavities of said slipform assemblies;

(e) means for vertically displacing said slipform assemblies incrementally relative to said frame as the concrete sets within said cavities and further concrete is supplied thereto, thereby to continuously and simultaneously cast a plurality of concrete panels having a vertical orientation;

(f) means for controlling said concrete supply means and said vertical displacing means in accordance with progressive setting of the concrete within said cavities, thereby to continuously and simultaneously cast a plurality of concrete panels having a vertical orientation with maximum efficiency;

(g) means for sensing the position of said vertical displacing means and said slipform assemblies and for sensing the condition of the concrete during the slipforming operation, said sensing means producing output signals to said controlling means which processes said signals and adjusts said concrete supply means and said vertical displacing means responsive to said signals, thereby to automate the slipforming operation; and (h) a plurality of ground-engaging wheels connected with a bottom portion of said frame enabling said frame to be transported to and positioned along the ground at a job site for forming vertical walls at a desired location.

2. Apparatus as defined in claim 1, wherein said vertical displacing means comprises a plurality of vertical cylinders connected between said strongback assembly and said frame, whereby extension and retraction of a piston associated with each cylinder lowers and raises said slipform assemblies.

3. Apparatus as defined in claim 2, wherein said cylinders comprise hydraulic cylinders and said vertical displacing means includes means for controlling the operation of said hydraulic cylinders, thereby to control the vertical displacement of said slipform assemblies.

4. Apparatus as defined in claim 3, wherein said form surfaces include a coating of synthetic plastic material to prevent the concrete from adhering thereto.

5. Apparatus as defined in claim 1, and further comprising side walls and a top wall removably connected with said frame to define a chamber, and heating means connected with said frame for heating said chamber, whereby slipforming of concrete walls may be carried out within said chamber during inclement weather.

6. Apparatus as defined in claim 1, wherein said sensing means includes a concrete level and temperature sensor for each cavity of the slipform assemblies, a wall height sensor connected with said vertical displacing means, and a form spacing sensor.

7. Apparatus as defined in claim 6, and further comprising means for laterally displacing and tilting the forms of each slipform assembly with respect to each other.

* * * * *

UNITED STATES PATENT AND TRADEMARK OFFICE

CERTIFICATE OF CORRECTION

PATENT NO. : 5,198,235
DATED : March 30, 1993
INVENTOR(S) : Stuart W. Reichstein, et. al.

It is certified that error appears in the above-indentified patent and that said Letters Patent is hereby corrected as shown below:

Title page, item [76] inventor: should be -- Gerald--.

Title page, item [76], inventor's address should be as following:

--14804 Keeneland Cir.
North Potomac, MD 20878 --.

Signed and Sealed this

Eleventh Day of January, 1994

Bruce Lehman

*Attest:*

BRUCE LEHMAN

*Attesting Officer*

*Commissioner of Patents and Trademarks*